US012305469B2

(12) United States Patent
Michaud et al.

(10) Patent No.: US 12,305,469 B2
(45) Date of Patent: May 20, 2025

(54) POWERED CLAMP CLOSURE MECHANISM

(71) Applicant: BEYOND ENERGY SERVICES AND TECHNOLOGY CORP., Calgary (CA)

(72) Inventors: George James Michaud, Beaumont (CA); Stewart George Wilson, Red Deer (CA); Charles Erle Norvila, Blackfalds (CA)

(73) Assignee: BEYOND ENERGY SERVICES AND TECHNOLOGY CORP., Calgary (CA)

( * ) Notice: Subject to any disclaimer, the term of this patent is extended or adjusted under 35 U.S.C. 154(b) by 0 days.

(21) Appl. No.: 18/743,740

(22) Filed: Jun. 14, 2024

(65) Prior Publication Data

US 2024/0410247 A1 Dec. 12, 2024

Related U.S. Application Data

(63) Continuation of application No. 17/904,630, filed as application No. PCT/CA2021/000012 on Feb. 19, 2021, now abandoned.

(30) Foreign Application Priority Data

Feb. 21, 2020 (CA) ..... CA 3073437

(51) Int. Cl.
*E21B 33/08* (2006.01)
*E21B 33/038* (2006.01)

(52) U.S. Cl.
CPC ..... *E21B 33/085* (2013.01); *E21B 33/038* (2013.01)

(58) Field of Classification Search
CPC ..... E21B 33/085; E21B 19/06; E21B 33/038; E21B 19/02; E21B 19/00
See application file for complete search history.

(56) References Cited

U.S. PATENT DOCUMENTS 3,162,939 A * 12/1964 Wendell ..... E21B 19/00 29/283
5,647,444 A * 7/1997 Williams ..... E21B 33/085 166/84.1
5,662,181 A * 9/1997 Williams ..... E21B 33/085 166/84.3
5,671,961 A * 9/1997 Buck ..... B25B 5/147 294/203

(Continued)

FOREIGN PATENT DOCUMENTS

WO WO-2015133884 A1 * 9/2015 ..... E21B 33/085

*Primary Examiner* — Daniel P Stephenson
(74) *Attorney, Agent, or Firm* — Heslin Rothenberg Farley & Mesiti P.C.

(57) ABSTRACT

A powered clamp assembly for use on managed pressure drilling rig comprising:

a first jaw and a second jaw, each one of said jaws comprising a pivot extremity and a locking extremity, each one of said pivot extremity comprising a structural member jutting outwardly from its respective jaw and pivotally connected to a bridging means;

each one of the locking extremities is connected to one another through a closure means;

wherein the movement of said first jaw and said second jaw allows movement of said jaws between a proximal position in relation to each other and a distal position.

14 Claims, 4 Drawing Sheets

(56) References Cited

U.S. PATENT DOCUMENTS

| | | | | |
|---|---|---|---|---|
| 5,904,075 | A * | 5/1999 | Buck | E21B 19/164 81/57.2 |
| 9,163,473 | B2 * | 10/2015 | Linde | E21B 33/064 |
| 9,260,934 | B2 * | 2/2016 | Godfrey | E21B 33/085 |
| 9,551,194 | B1 * | 1/2017 | Baryam | B25B 13/52 |
| 10,145,199 | B2 * | 12/2018 | Linde | E21B 33/085 |
| 11,598,172 | B2 * | 3/2023 | Whitehead | E21B 33/064 |
| 2023/0110604 | A1 * | 4/2023 | Michaud | E21B 33/038 166/65.1 |
| 2024/0410247 | A1 * | 12/2024 | Michaud | E21B 33/085 |

* cited by examiner

POWERED CLAMP CLOSURE MECHANISM

CROSS REFERENCE TO RELATED APPLICATIONS

This application is a continuation application under 35 U.S.C. 120 of U.S. Ser. No. 17/904,630, filed Aug. 19, 2022, which is a U.S. National Phase filing under 35 U.S.C. § 371 of International Application PCT/CA2021/000012, filed Feb. 19, 2021, and published as WO 2021/163784 A1 on Aug. 26, 2021. PCT/CA2021/000012 claims priority from Canadian patent application number 3,073,437, filed Feb. 21, 2020. The entire contents of each of these prior applications are hereby incorporated herein by reference.

FIELD OF THE INVENTION

The present invention relates to a powered clamp for use in the oil and gas industry, more specifically a hydraulic clamp used in managed pressure drilling operations.

BACKGROUND OF THE INVENTION

When drilling for oil and gas, one encounters geological formations that have a narrower tolerance for changes in bottom hole pressure. A widely adopted solution to this problem is the so called 'Managed Pressure Drilling' (MPD). In this method of drilling, the annular space is closed to the atmosphere by means of a Rotating Control Device (RCD). An RCD is a pressure-control device used during drilling for the purpose of making a seal around the drill string during its rotation and/or tripping in and out of a well. The RCD is designed to contain or divert hydrocarbons or other wellbore fluids and pressure and prevent their release to the atmosphere. The RCD diverts the fluid into a manifold equipped with a specialized choke that allows manipulation of the well's bottom hole pressure. Right before breaking a connection to add a new stand, the pumps are ramped down. At the same time, the dynamic component of the bottom hole pressure drops and needs to be compensated for, in order to maintain a near-constant bottom hole pressure.

In the oil and gas industry, it is paramount to ensure the safety of employees, a problem that may jeopardize employees' safety on a drilling rig is known as a "blowout". When a zone of high geopressure is encountered during a drilling operation and the pressure exceeds the hydrostatic pressure exerted by the drilling mud, and the formation has sufficient permeability to allow fluid flow, then the formation fluid will move into the wellbore and displace the drilling mud. This is referred to as a "kick"; and if unchecked it will result in a "blowout" which is an uncontrolled release of crude oil and/or natural gas from an oil well Through the use of an MPD system which includes an RCD a kick can be safely controlled.

U.S. Pat. No. 9,163,473 discloses a RCD which includes a housing assembly which contains a bearing assembly and an annular seal which rotates and seals off an annulus between a tubular string and an RCD body, a remotely operable clamp device which selectively permits and prevents relative displacement between the housing assembly and the body, and a remotely operable safety latch which selectively permits and prevents unclamping of the clamp device. A method of remotely operating an RCD clamp device can include remotely operating a safety latch which selectively permits and prevents unclamping of the clamp device, and remotely operating the clamp device while the safety latch is in an unlatched position, thereby unclamping a bearing housing assembly from the RCD body. Another RCD can include a remotely operable clamp device which selectively permits access to an RCD body interior, and a remotely operable safety latch which selectively prevents unclamping of the clamp device.

Despite the existing prior art, there still exists a need for a robust, reliable powered clamp assembly to seal the wellbore from the atmosphere during managed pressure drilling. Preferably, such hydraulic clamp should also be operable remotely to increase the personnel's safety around the wellbore.

Most of the existing art that exists around RCD clamps still result in having a person atop the annular BOP to install a safety pin or means of ensuring the clamp remains closed in the event of loss of hydraulic pressure. Manual clamp technology causes an operator to place a person atop the annular so as to open/close the manual clamp which in turn introduces a significant safety concern especially when dealing with hydrocarbons and pressure. Preferably such a hydraulic clamp should also include a safety mechanism or method that ensures the clamp remains closed in the event of the loss of hydraulic pressure.

SUMMARY OF THE INVENTION

Accordingly, there is provided a powered clamp assembly for use on an RCD which allows the RCD and accessories to be installed or retrieved without having to have personnel atop the annular BOP during critical operations.

According to an aspect of the present invention there is provided a powered clamp assembly for use on an RCD comprising:

- a first jaw and a second jaw, each one of said jaws comprising a pivot extremity and a locking extremity, each one of said pivot extremity comprising a structural member jutting outwardly from its respective jaw and pivotally connected to a bridging means;
- each one of the locking extremities is connected to one another through a closure means;
- wherein the movement of said first jaw and said second jaw allows movement of said jaws between a proximal position in relation to each other and a distal position.

According to a preferred embodiment of the present invention, there is no need for a safety pin or any additional manual safety device. Position locking with a failure of the external power source is achieved thru trapping operating pressure in the locking actuator as well as thru friction from operating loads.

According to a preferred embodiment, the closure means maintains contact with the locking extremity of each one of said first and second jaw when such are in said distal position in relation to each other.

According to a preferred embodiment, the closure means is selected from the group consisting of: a threaded screw mechanism; a latch mechanism; and a double clasp mechanism.

According to a preferred embodiment, the closure means are actuated remotely. Preferably, the powered clamp assembly further comprises a second closure means. Preferably, the powered clamp assembly further comprises a threaded screw mechanism connecting the closing extremities of said first and second jaw together and a double latch mechanism.

According to an aspect of the present invention, there is provided a powered clamp assembly for use in managed pressure drilling which is expandable through a combination of a pivot and articulations between a substantially open position and a substantially closed position. One of the advantages of the present invention is the capacity to maintain the alignment of a first jaw and a second jaw, upon opening so that upon closure said first and second jaw are in alignment. Said first jaw and second jaw each having a first extremity and a second extremity, wherein said first extremity of said first jaw and said second jaw are positioned proximate one another, and wherein the second extremity of said first jaw and said second jaw are in abutment with one another when said hydraulic clamp is in a closed position and second extremity of said first jaw and said second jaw are spread apart when said hydraulic clamp is in an open position.

According to a preferred embodiment, each one of said first and second jaw are pivotally mounted to a pivot point. Preferably, each one of said first and second jaw are pivotally mounted to a first and a second pivot point respectively. Preferably, the first and second pivot points are positioned proximate each other. Preferably, each jaw covers half of the circumference of a tube on which it is applied. More preferably, each jaw has a hemicircular shape in order to adapt to the contour of the tube upon which it will be applied and be tightened. Preferably, each jaw's shape is adapted to form a tight lock on the tube upon which it is meant to be tightened and be complementing of each other's geometry to surround the entirety of the tube's circumference.

According to a preferred embodiment of the present invention, the second extremity of said first jaw and second jaw are secured together using a breech lock. Preferably, the second extremity of said first jaw and second jaw are maintained in permanent connection with one another through threaded screw part of the breech lock. This is combined with a toggle latch to provide additional security when locking the clamp assembly. Preferably, the toggle latch is a double toggle latch. The primary locking means can be described as a "breech lock". The breech lock consists of an externally threaded rod and internally threaded socket which have part of the threads removed so they can mate. According to a preferred embodiment of the present invention, when in operation, the socket is actuated in a non-continuous rotary motion of approximately 90 degrees while the rod is stationary. The pitch of the threads combined with the rotation causes the latch to tighten.

According to a preferred embodiment of the present invention, a feature of the powered clamp assembly is that there is no need for a safety pin or any additional manual safety device. This is achieved through the self-locking nature of the threaded rod/socket interface as well as the ability to maintain pressure applied to the rotary actuator.

According to a preferred embodiment of the present invention, the means of load holding and closure are two separate items. The linkage and cylinder arrangement which is used only to open/close the two clamp halves, and the breech lock which is the primary load holding and locking apparatus. Preferably, the linkage can be described as a linkage which can be acted on by any sort of linear actuator (s) (be it hydraulic, electric, etc.) and a breech lock which can be operated by a rotary actuator (but not a motor as used in the reference patent). It is important to note the difference between a rotary actuator and a motor as it is an important distinction. A rotary actuator as described herein has a limited range of motion with physical stopping points. Usually 90 or 180 degrees, as contrasted with a motor which has no physical rotation limits. The prior art device mentioned earlier disclose a continuous rotation motor. Moreover, a breech lock functions with 90 degrees (or less depending on the design) of rotational movement where the screw mechanism in the prior art patent requires continuous rotation to function.

According to a preferred embodiment of the present invention, the clamp sections are moved to either the open or closed position by the linkage/linear actuators. That is their only function. The cylinders are not load-bearing or position-locking. The prior art device discussed previously, requires that the cylinder or screw mechanism fulfills both the functions of movement and load bearing. Accordingly and to reduce the possibility of breakage, a preferred embodiment of the present invention comprises a breech lock as the only load bearing member and which, moreover, does not contribute to clamp movement to or from open and closed.

BRIEF DESCRIPTION OF THE FIGURES

The detailed description will be better understood in conjunction with the accompanying drawings as follows.

BRIEF DESCRIPTION OF A PREFERRED EMBODIMENT

Figure 1:
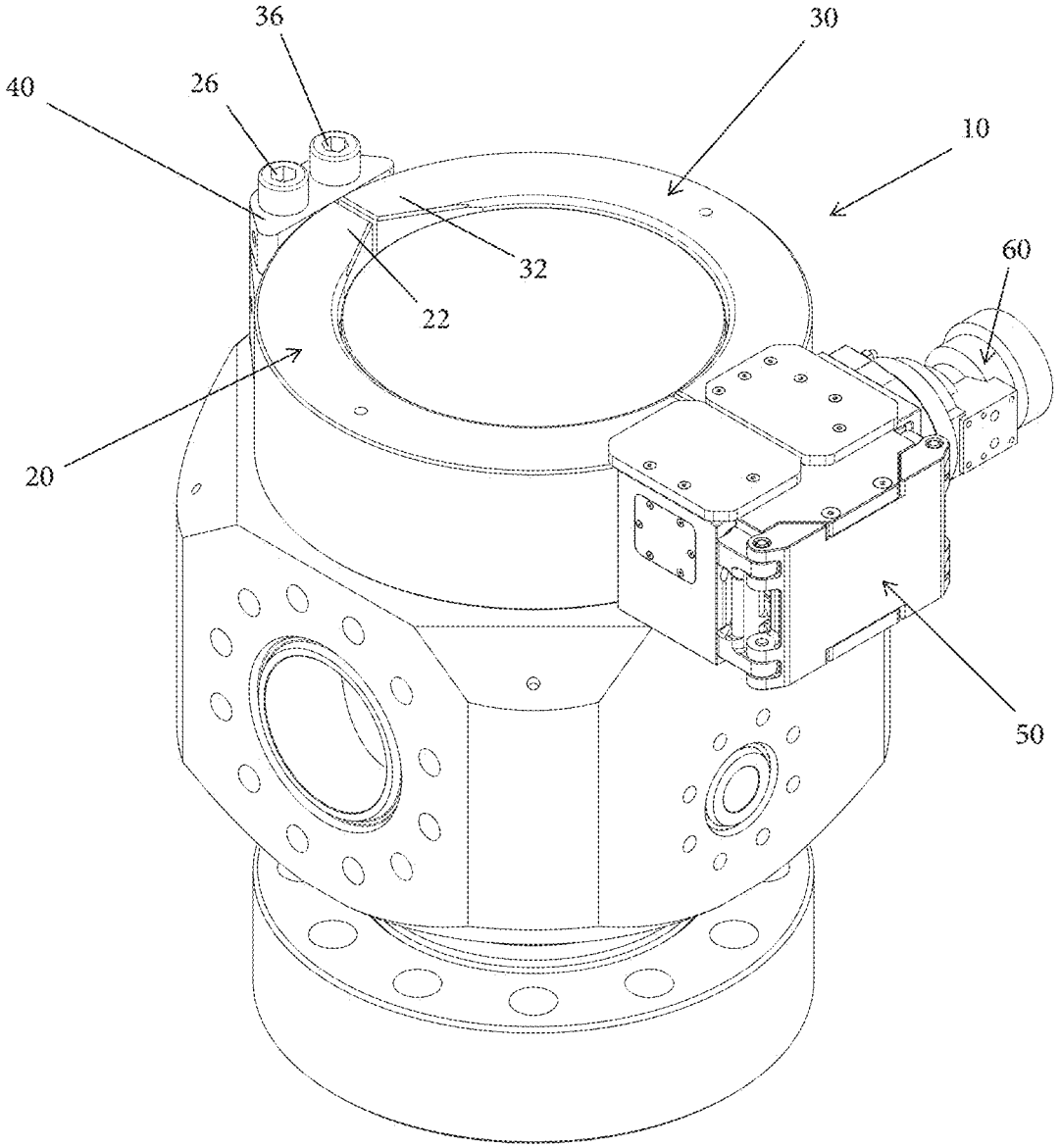
FIG. 1 is a front perspective view of the powered clamp according to a preferred embodiment of the present invention in a closed position.
Figure 2:
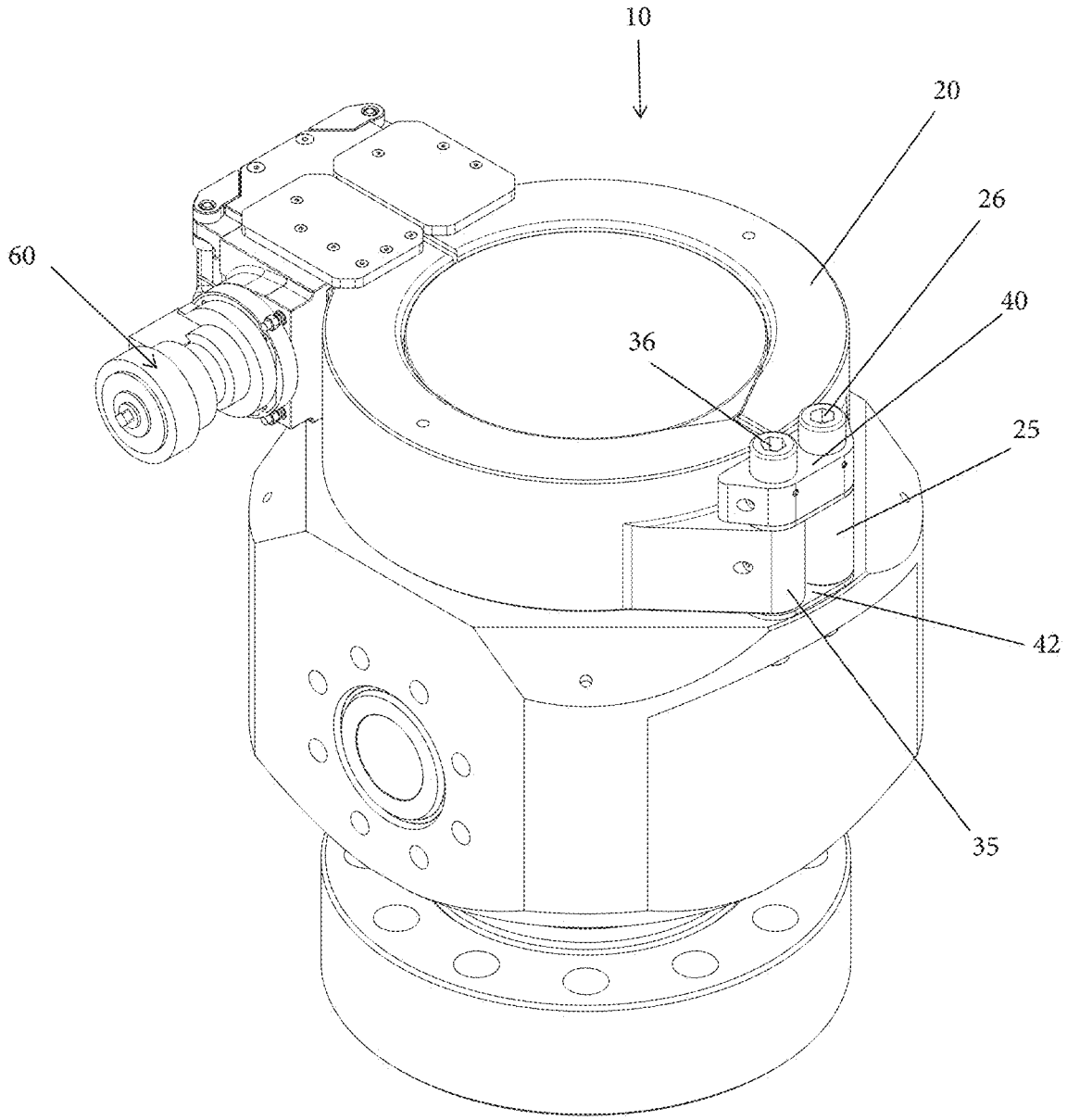
FIG. 2 is a back perspective view of the powered clamp according to a preferred embodiment of the present invention in a closed position.

As seen in FIGS. 1 to 4, the powered clamp assembly (10) according to a preferred embodiment of the present invention comprises a first (20) and a second jaw (30). Each one of said jaws comprising a pivot extremity (22, 32) and a locking extremity (24, 34). Each one of said pivot extremity (22 and 32) comprising a member (25, 35) jutting outwardly from the jaw (20, 30) and pivotally connected to a bridging means (40) through a pin (26, 36) or any equivalent mechanical component which permits rotation. Optionally, and as illustrated, the bridging means (40) may comprise a second bridging element (42) located under the members (25, 35). Alternatively, the bridging means may extend from the top side (27, 37) of the members (25, 35) to the bottom side (not shown) as a single piece. According to an alternative embodiment, the bridging means can comprise a single pivot point onto which both members jut thereonto.

Figure 3:
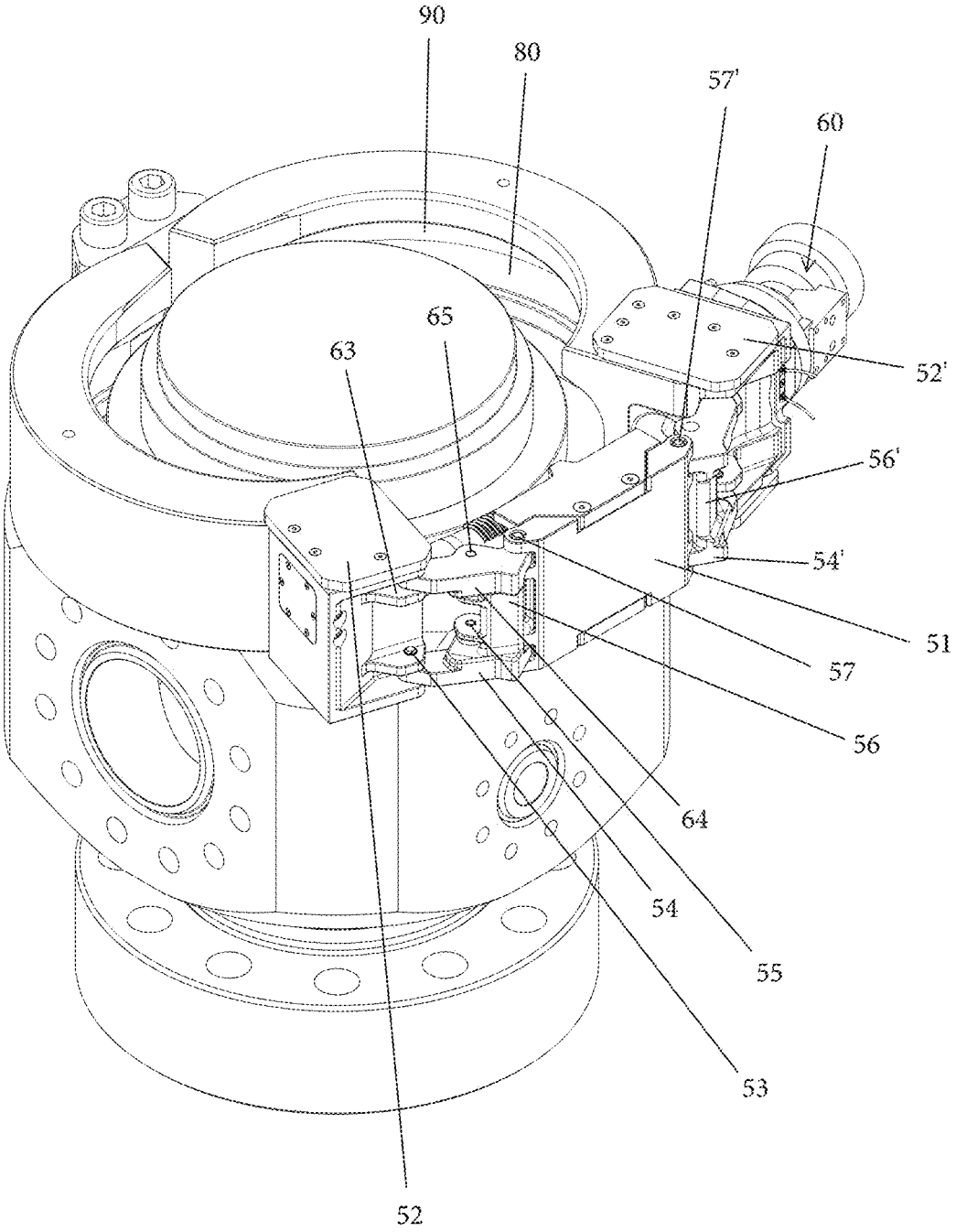
FIG. 3 is a front perspective view of the powered clamp according to a preferred embodiment of the present invention in an open position.
Figure 4:
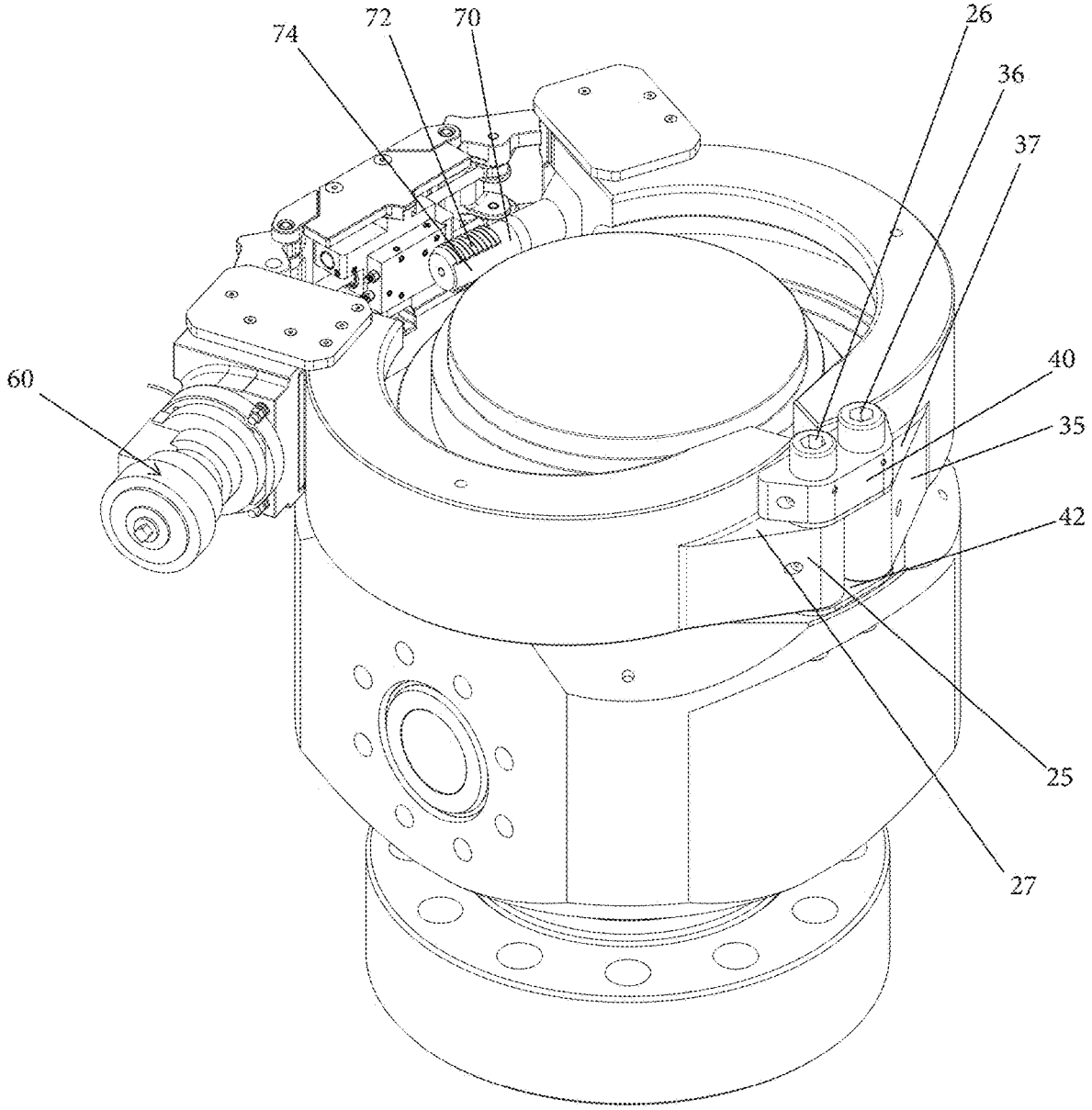
FIG. 4 is a back perspective view of the powered clamp according to a preferred embodiment of the present invention in an open position.

As shown in the preferred embodiment, the locking extremities (24, 34) of the jaws (20, 30) are in permanent connection with one another through a double clasp mechanism (50) which allows the opening and closing of the jaws all the while maintaining them in alignment. Correct alignment of the two jaws upon closure of the clamp is highly desirable as the internal surfaces of each jaw must contour the tubing with as much surface as possible to ensure effectiveness of the clamp. Thus, the inner circumferential shape created by the first and second jaw when in a closed position should be such that it frictionally engages the tube around which it is disposed. Preferably, the profile of the clamps matches the profile formed by the body neck and RCD or accessory. According to a preferred embodiment and as shown in FIGS. 3 and 4, one notes that the internal surface of the jaws is not flat but rather it has grooves (80 and 90) adapted to contour a specific type of RCD and/or accessories set-up. The internal surface of the jaws (grooves or no grooves) in no way affects how the clamp assembly operates, it just determines RCD body, RCD, and accessory compatibility.

The closing mechanism is a double latch mechanism (50) comprises a link (51) connecting the two symmetrical latch assemblies together. Each latch assembly is connected to its respective locking extremity (24, 34) through member (52, 52'). Member (52) is pivotally connected at pivot point (53, 63) an element (54, 64) which also rotates at point (55, 65). Member (52) is in connection with element (56) through pivot point (55, 65) and in rotational connection with link (51) through the two-part pivot point (57). Meanwhile, element (56) also has a pivot connection (not shown) with link (51) to allow for the toggle latch to operate as such.

According to the illustrated embodiment, the closing mechanism is a double latch mechanism (50) and is equipped with a second locking mechanism comprising a threaded screw mechanism (60) connecting the locking extremities (24, 34) of each jaw together over and above the double latch mechanism. According to the illustrated embodiment in FIG. 4, the threaded screw mechanism (60) employs a threaded screw (70) having a threaded portion (72) which portion has a non-threaded section (74). The non-threaded section (74) allow for the mechanism (60) to slip over the threaded screw (70) more easily prior to tightening of the mechanism (6) to ensure a secure locking of the jaws together during the performance of the hydraulic clamp assembly (60).

Preferably, the powered clamp comprises an actuator to move the two jaws between a first closed position (see FIGS. 1 and 2) where the clamp is fully shut and a second position where the two jaws are in an open position where their respective locking extremity are in a position distal from each other (see FIGS. 3 and 4). Preferably, the actuator can be mechanically driven, electrically-driven or hydraulically-driven. An actuator operates the mating socket displacement onto and along the threaded screw to tighten or release the jaws. Preferably, also, the latch clasp may also be activated through the operation of a second actuator. This allows the operator to remotely operate the hydraulic clamp and heighten the security of workers. Moreover, it is believed that only one of the two locking mechanisms (latch and threaded screw) is necessary to maintain the two jaws in alignment. The redundancy of this preferred embodiment increases the safety of its use in various operations and allows operators to remotely operate the clamp.

As seen in FIGS. 3 and 4, the locking mechanism is a latching mechanism and is made up of a sequence of articulated elements acting in concert to perform a latch closure. The latching mechanism is believed to be highly desirable as it can provide a safe closure all the while providing the operator to actuate it remotely. Preferably, the latch mechanism permanently connects the jaws to each other and therefore ensures the alignment thereof when the clamp is closed. In addition to remote operation, position indication sensors are used to remotely indicate the status of the two operation stages with either "open" or "closed". This removes the need for visual confirmation of apparatus position which also enhances safety and operational efficiency.

According to a preferred embodiment, there is no need for a safety pin or any additional manual safety device. This is achieved through the self-locking nature of the treaded rod/socket interface as well as the ability to trap pressure applied to the rotary actuator.

According to a preferred embodiment, the clamp assembly comprises two factors which negate the need for a safety latch. One being the thread geometry selected for the main rod/nut is inherently self-locking, the other factor being that the hydraulic valving used is directly mounted to the rotary actuator which will prevent any movement until the actuator direction is reversed. This can be achieved since the rotary actuator in question has no internal leakage (as compared to a motor, which does have internal leakage).

According to a preferred embodiment, one of the means of motion to achieve clamp opening and closing is using opposing dual acting cylinders as compared to a screw drive in the prior art document discussed earlier. According to a preferred embodiment of the present invention, the open/close cylinders move the clamp through a linkage which allows the powered clamp assembly to be much more compact when in the closed position and shields the moving parts from any possible damage which could be potentially caused by impacts from other objects being lifted or moved. Contrary to the prior art, where the mechanism disclosed has the primary load acting through the open/close cylinder, in a preferred embodiment of the present invention, the primary load never goes through the movement cylinders. This is one of the reasons the clamp assembly according to a preferred embodiment of the present invention is compact.

According to a preferred embodiment of the present invention, when in use the clamp can be tightened around a tube remotely either wirelessly or through a cable connected to the powered clamp. The operator, which is located at a safe distance from the wellbore and hence the powered clamp, enters instructions or operates controls which are meant to release the lock mechanism, once the lock mechanism has been operated, the closure is opened and the clamp's grip is loosened to allow the RCD or accessories to be removed or installed into the RCD body.

As is understood by the person skilled in the art to which this disclosure is addressed, the pivot extremity, the locking extremity, and the locking mechanism can take different forms but still be considered to be part of the inventive concept as described and illustrated herein. The embodiments described herein are to be understood to be exemplary and numerous modification and variations of the present invention are possible in light of the above teachings. It is therefore to be understood that within the scope of the claims appended hereto, the invention may be practiced otherwise than as specifically disclosed herein.

The invention claimed is:

1. A powered clamp assembly for use on a rotating control device (RCD) on a managed pressure drilling rig comprising:

a first jaw and a second jaw, each one of said jaws comprising a pivot extremity and a locking extremity, each one of said pivot extremity comprising a structural member jutting outwardly from its respective jaw and pivotally connected to a bridging means;

each one of said locking extremity configured to connect to one another through a closure means, wherein the closure means comprise a linkage and actuator arrangement;

and wherein the movement of said first jaw and said second jaw by said linkage and actuator arrangement allows movement of said first and second jaws between a proximal position in relation to each other and a distal position.

2. The powered clamp assembly according to claim 1 wherein said closure means maintains contact with the locking extremity of each one of said first and second jaw when such are in said distal position in relation to each other.

3. The powered clamp assembly according to claim 1 further comprising a load holding and locking means selected from the group consisting of a threaded screw mechanism and a breech lock mechanism.

4. The powered clamp assembly according to claim 3 wherein the load holding and locking means and closure means are two different components.

5. The powered clamp assembly according to claim 3 wherein the load holding and locking means is operated by a rotary actuator.

6. The powered clamp assembly according to claim 3 wherein the load holding and locking means is operated by a rotary actuator selected from the group consisting of a hydraulic actuator, an electric actuator, and a mechanically-driven actuator.

7. The powered clamp assembly according to claim 3 wherein the load holding and locking means associated with closure of said clamp consists of a threaded screw mechanism.

8. The powered clamp assembly according to claim 1 wherein said closure means are actuated remotely.

9. The powered clamp assembly according to claim 1 wherein the linkage and actuator arrangement is solely used only to open/close the first and second jaws.

10. The powered clamp assembly according to claim 1 wherein the linkage and actuator arrangement is operated by a linear actuator.

11. The powered clamp assembly according to claim 1 wherein the linkage and actuator arrangement is operated by a linear actuator selected from the group consisting of a hydraulic actuator, an electric actuator, and a mechanically-driven actuator.

12. The powered clamp assembly according to claim 1 further comprising a threaded screw mechanism connecting the locking extremities of said first and second jaw.

13. The powered clamp assembly according to claim 1 further comprising an inner circumferential shape created by the first and second jaw when in a closed position such that it frictionally engages a tubing around which it is disposed.

14. The powered clamp assembly according to claim 13, where an internal surface of the first and second jaw comprises at least one groove adapted to contour a specific type of rotating control device (RCD) accessory set-up.

* * * * *